United States Patent [19]

Tailer et al.

[11] Patent Number: 4,676,066

[45] Date of Patent: Jun. 30, 1987

[54] PLUNGING CYLINDER LIQUID PISTON STIRLING ENGINE

[75] Inventors: Peter L. Tailer; Jonathan H. West, both of Vineyard Haven, Mass.

[73] Assignee: Windfarm Museum, Inc., Vineyard Haven, Mass.

[21] Appl. No.: 930,654

[22] Filed: Nov. 10, 1986

[51] Int. Cl.[4] ..... F02G 1/04

[52] U.S. Cl. ..... 60/517; 60/682

[58] Field of Search ..... 60/650, 682, 517, 530

[56] References Cited

U.S. PATENT DOCUMENTS 2,215,652 9/1960 Quinte ..... 60/530 X 2,755,619 7/1956 Sheft ..... 60/530

*Primary Examiner*—Allen M. Ostrager

*Attorney, Agent, or Firm*—Peter L. Tailer

[57] ABSTRACT

A Stirling engine has cylinders with closed upper ends and open lower ends. The cylinders are plunged out of phase into tanks of fluids at different temperatures. A connecting tube extends through the tanks and upward through the fluids into the cylinders to allow a working gas to be displaced between cylinders through the connecting tube. The connecting tube transfixes and mounts seals disposed within the cylinders and in the fluids. The seals may have a slight clearance between themselves and the cylinders as the fluids have a higher viscosity and inertia than the working gas to provide an effective seal while the engine is operating to displace, compress, and expand the working gas in a Stirling cycle. The fluids transfer and remove heat from the working gas through the connecting tubes, the cylinders, and direct fluid contact. If the seals are disks, have portions of their edges rounded, or are sections of a sphere, no crossheads are required for some configurations of this engine.

10 Claims, 7 Drawing Figures

PLUNGING CYLINDER LIQUID PISTON STIRLING ENGINE

BRIEF SUMMARY OF THE INVENTION

There is a need in less industrialzed countries for an inexpensive, very easily constructed power source. A low temperature differential Stirling engine according to this invention provides such a power source that can be powered by burning any fuel to provide hot water or by using solar heated hot water. If solar heated hot water is used, the solar collectors can use radiational cooling at night to provide cooled water to maximize the temperature differential.

One embodiment of this invention is a Stirling engine operating at atmospheric mean pressure with air as a working gas. The engine has two tanks, one containing hot water and the other cold. A connecting tube extends upward through the tanks above the levels of the water in the tanks. Cylinders with closed upper ends and open lower ends are plunged out of phase with each other by a crank or other mechanism into the tanks with the connecting tubes extending into the cylinders through their open lower ends. Seals of a smaller diameter than the cylinders leaving a slight clearance between the seals and the cylinders are mounted on the connecting tube within the cylinders and below the fluid levels. The much higher viscosity and inertia of water than air enables the out of phase plunging of the cylinders to have water above the seals remain substantially at the same level to provide liquid piston power and displacer pistons for Stirling engine configurations.

The seals may serve as cylinder guides. With disk or spherical seals, direct fixing of the cylinders to a crank without crossheads is practical as the seals function with the resulting rocking and plunging motion of the cylinders.

In industrialized countries, there is a need to utilize waste heat from power plants, industrial processes, geothermal sources, and the like. By using a fluid other than water, such as corn oil, cotton seed oil, a petroleum derived oil, or the like, that can be heated to a higher temperature than water without vaporizing, a higher temperature differential can be used with a resulting higher thermal efficiency. The use of a fluid or fluids that are good lubricants will provide a very long cylinder and seal life.

A main advantage of the engine of this invention is its ease of construction with no close tolerances and minimal machining. Although larger in displacement than a conventional Stirling engine for a given power, it can be produced for a lower cost.

SPECIFICATION

Figure 1:
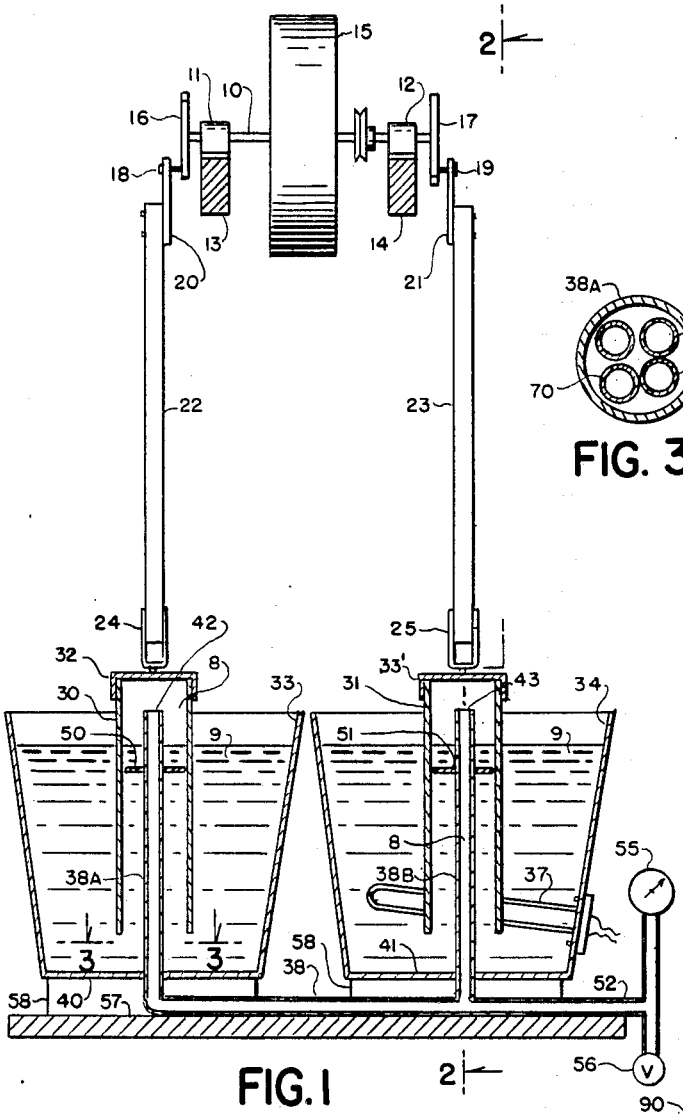
FIG. 1 is a vertical section through a Stirling engine according to this invention.

As shown in FIG. 1, the Stirling engine of this invention can be of the utmost simplicity. A shaft 10 journaled in bearings 11 and 12 on frame members 13 and 14 mounts a flywheel 15. Cranks 16 and 17 are fixed on the ends of shaft 10. Crank journals 18 and 19 have upper ends 20 and 21 of connecting rods 22 and 23 connected to them.

The lower ends of connecting rods 22 and 23 have brackets 24 and 25 bolted to them. The cylinders 30 and 31 may be lengths of tubing with caps 32 and 33 soldered on them. The caps 32 and 33' are bolted to the brackets 24 and 25. The tanks 33 and 34 each contain water 9. Tank 34 may have an electric heating element 37 mounted in it to heat water 9 therein for test purposes.

A connecting tube 38 is sealed with fluid tight joints to have upstanding runs 38A and 38B extend through the tank bottoms 40 and 41. The open ends 42 and 43 of the connecting tube 38 extend above the fluid 9 in the tanks 33 and 34. Fixed on the upstanding runs 38A and 38B of the connecting tube 38 below the levels of the water 9 in the tanks 34 and 35 are two metal disk seals 50 and 51 with diameters slightly smaller than the inside diameters of the cylinders 30 and 31.

One end 52 of connecting tube 38 mounts a pressure guage 55 and a drain valve 56. Connecting tube 38 is clamped to a frame base 57 which mounts the upstanding tank rests 58. Connecting tube 38 contains a working gas 8 which may be air.

The optimum compression ratio for a Stirling engine depends on its operating temperature differentials. When the cranks 16 and 17 were set 90° out of phase on a test engine and the engine pulled through, the pressure change on guage 55 excedded 7 psi, but the engine would not run.

When operating an experimental engine according to this invention, it was found that it ran and developed maximum power when the cranks 16 and 17 were 135° to 145° out of phase. The pressure change on guage 55 was then only about 3 psi.

Figure 3:
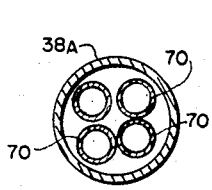
FIG. 3 is a horizontal section taken on line 3—3 of FIG. 1 through a connecting tube.

With low temperature differentials driving a Stirling engine, sufficiently large and effective heat exchange areas were found to be required. As shown in FIG. 3, four metal tubes 70 were placed in each vertical run 38A and 38B of connecting tube 38. These tubes 70 provided added heat transfer area needed to run the engine. The runs 38A and 38B were heated and cooled by water 9 and, by conduction, heated or cooled the tubes 70.

As one specific example of this invention, an engine was built using 3 gal. buckets as tanks 33 and 34, 2" id sweat copper tubing 12.5" long as cylinders 30 and 31, and a connecting tube of ¾" copper tubing soldered through the bucket bottoms 40 and 41 and the seals 50 and 51. The seals 50 and 51 were of ¼" steel machined 0.010" less than the diameter of the cylinders 30 and 31.

The distance from axle 10 to seals 50 and 51 was 40". At the top of a 5" stroke, the bottoms of cylinders 30 and 31 were ½" below the seals 50 and 51 which were 2" below the level of the water 9. The open ends 42 and 43 of the connecting tube 38 were 3" above the level of water 9. Heat transfer tubes 70 were four ¼" od, 3/16" id copper tubing. A small air leak in connecting tube 38 near guage 55 seemed to stabilize the level of fluid 9 in the cylinders 30 and 31. With a 140° F. temperature differential having water 9 in hot tank 34 at 205° F. and in cold tank 33 at 65° F., the engine produced 1.5 watts of shaft power at 82 rpm with a 5" stroke and the cranks 135° out of phase.

Figure 2:
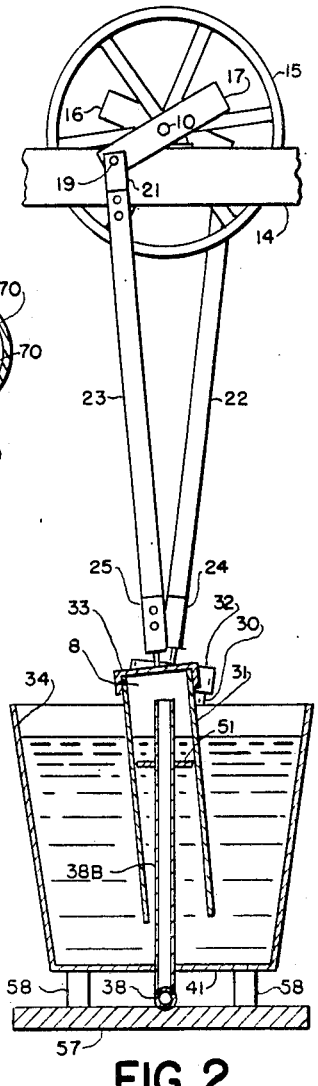
FIG. 2 is a vertical section through the engine taken on line 2—2 of FIG. 1.
Figure 4:
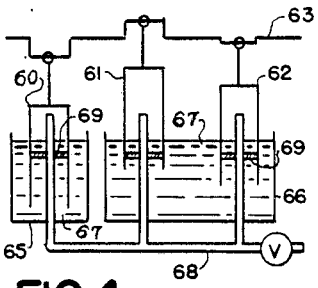
FIG. 4 is a schematic diagram of a gamma configuration Stirling engine according to this invention.

A Stirling engine known in the literature as an alpha configuration is shown in FIGS. 1 and 2. FIG. 4 shows a gamma configuration. A crank 63 plunges cylinders 60 and 61 180° out of phase into fluid 67 in hot tank 65 and cold tank 66. Crank 63 also plunges a power cylinder 62 in cold tank 66 out of phase with and following hot cylinder 60. Connecting tube 38 extends upward into all cylinders 60, 61, and 62. Seals 69, as hereinbefore described, are mounted on connecting tube 68.

A high technology Stirling engine according to this invention could be inexpensively made in large scale and use fluid 9 or 69 that would not vaporize at elevated temperatures above the boiling point of water. This would raise the thermal efficiency of the engine. The fluid would also serve as a lubricant for spherical or other seals to give the engine an exceptionally long service life.

As the engine is scaled up, estimates of potential power production can be made. Given the same cylinder speed as the experimental engine, power produced will be directly proportional to the cylinder area. If a large engine has cylinders 30 and 31 that are 36" in diameter, the large engine will produce 324 times the power of the experimental engine with the same cylinder speed. It can be assumed that cylinder speed in a large engine can be increased at least ten times with resulting lower fluid friction losses as the cylinder volume to cylinder area ratio will increase with lower fluid friction losses. Thus the larger engine should produce 3240 times the power of the experimental engine. Further, the experimental engine had a lot of excess dead space and other losses that resulted from its small scale. In the larger engine seal clearances between seals 50 and 51 and cylinders 30 and 31 could be at least proportionately larger than the increase in cylinder diameter and still adequately restrict fluid flow through the clearances past the seals 50 and 51. Thus a conservative power estimate for a well designed engine with 36" dia cylinders with a 36" stroke operating at 120 rpm with a temperature differential of 120° F. should be at least 5 kw and may be as high as 30 kw.

Thermal insulation of the tanks 34 and 35 and their surrounding air spaces should allow a high mechanical efficiency after the given temperature differential thermal efficiency. In a larger engine, suitable instrumentation and controls could maintain an exact desired mean pressure in connecting tube 38 so the runs 38A and 38B need only extend a proportionately smaller distance above the fluid 9. This would reduce dead space and increase power.

Figure 5:
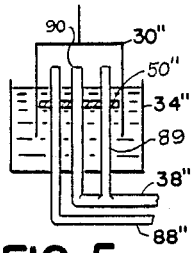
FIG. 5 is a schematic representation of one tank and a plunging cylinder of a Stirling engine having a plurality of connecting tubes extending into the cylinder.

Since heat conductivity to and from the working gas 8 depends on a given heat transfer area for a given volume of gas 8 displaced between hot and cold cylinders 31 and 40, in larger engines a multiplicity of connecting tubes 38" and 88 may be required to provide sufficient heat transfer area. FIG. 5 shows a plurality of heat transfer tubes 38" and 88 extending into a tank 34" through a seal 50" to provide an adequate heat transfer area for larger volumes of a working gas such as air moved by a plunging cylinder 30". Connecting tube 38" has two upstanding ends 89 and 90 manifolded from it.

Figure 6:
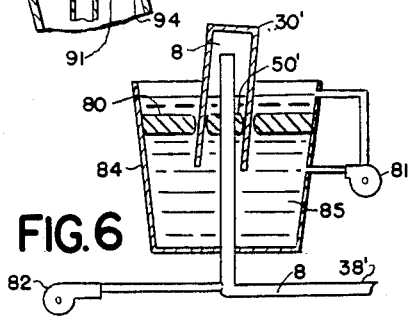
FIG. 6 is a vertical section through one tank and a plunging cylinder of a Stirling engine that are pressurized; and, FIG. 7 is a vertical section through a fragment of a connecting tube, a seal fixed thereon, and a fragment of a cylinder shown rocked in one direction.

As shown in FIG. 6, raising the mean pressure would be possible if an external seal 80 was disposed about a cylinder 30' in tank 84 at the level of seal 50'. If a straight line motion was provided for cylinder 30', the seals 80 and 50' need not be at the same level. Pump 81 pressurizes fluid 85 in tank 84 below seal 80 by returning fluid leaking above seal 80 below it. The working gas 8 in connecting tube 38' is pressurized by a pump 82 so that the mean pressure in the engine is about equal to the fluid pressure below seal 80. Suitable instrumentation and controls are required for the pumps 81 and 82 which could easily be added to a larger engine.

If the seals 50 and 51 of the engine of FIG. 1 are removed and replaced by cylinder guides (not shown) external to or within the cylinders 30 and 31, the engine will run at reduced power if delicately made or of a sufficiently large scale. The cylinders 30 and 31 then operate at negative and positive pressure according to the distance water 9 is forced down or drawn up in the cylinders 30 and 31 above or below its level in the tanks 33 and 34.

Figure 7:
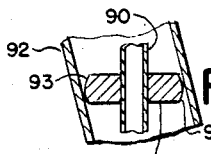

FIG. 7 shows a fragment of a connecting tube 90 with a seal 91 mounted on it. Seal 90 has edges 93 and 94 rounded to the radius of the seal 91 at least in the plane in which the cylinder 92 may be rocked by a connecting rod. Thus the clearance between the seal 91 and cylinder 92 remain constant even with rocking of cylinder 92. In some cases, spherical seals 91 will be easier to manufacture.

As with most Stirling engines, the engine of this invention can be driven by an external power source to function as a heat pump.

What is claimed is:

1. A Stirling engine comprising, in combination, cylinders having tops and open lower ends, tanks containing hot and cold fluid, means plunging said cylinders out of phase into said hot and cold fluid, at least one connecting tube providing a passage between the upper portions of said cylinders, and a working gas in the upper portion of said cylinders and said connecting tube.

2. The combination according to claim 1 wherein said tops of said cylinders are closed and said at least one connecting tube extends upward through the hot and cold fluid in said tanks through the open lower ends of said cylinders into said cyinders, said connecting tube having open ends disposed above the level of fluid in said cylinders.

3. The combination according to claim 2 with the addition of seals mounted within said cylinders below the level of said fluid within said cylinders, said seals restricting fluid flow therepast within said cylinders.

4. The combination according to claim 3 wherein said at least one connecting tube enters said tanks below said fluid level and is fixed to said tanks, said seals being transfixed by and being mounted on said at least one connecting tube.

5. The combination according to claim 4 wherein said seals and said cylinders have a clearance therebetween.

6. The combination according to claim 5 wherein said seals are cylinder guides.

7. The combination according to claim 6 wherein said means plunging said cylinders out of phase into said fluid is a non-linear mechanism rocking and reciprocating said cylinders about said seals, said seals being rounded at least in the plane in which said cylinders rock.

8. The combination according to claim 7 wherein said mechanism plunging said cylinders out of phase into said fluid is a crank mechanism disposed above said cylinders and having cranks and connecting rods, said connecting rods having upper and lower ends, said lower ends of said connecting rods being fixed to said cylinders and said upper ends of said connecting rods being attached to said cranks.

9. The combination according to claim 3 with the addition of an external seal disposed about each of said cylinders, pump means pressurizing fluid in said tanks below said external seals and returing fluid leaking above said external seals below said external seals, and pump means pressurizing said working gas within said cylinders and said at least one connecting tube.

10. The combination according to claim 7 wherein said seals are sections of a sphere.

* * * * *